US010991489B2

(12) United States Patent
Schneider et al.

(10) Patent No.: US 10,991,489 B2
(45) Date of Patent: Apr. 27, 2021

(54) INSULATION SYSTEM FOR A TOOL, TOOL, AND METHOD FOR MOUNTING THE INSULATION SYSTEM ON THE TOOL

(71) Applicant: Robert Bosch GmbH, Stuttgart (DE)

(72) Inventors: Joerg Schneider, Fichtenberg (DE); Achim Kugler, Gschwend (DE)

(73) Assignee: Robert Bosch GmbH, Stuttgart (DE)

( * ) Notice: Subject to any disclaimer, the term of this patent is extended or adjusted under 35 U.S.C. 154(b) by 1671 days.

(21) Appl. No.: 14/505,172

(22) Filed: Oct. 2, 2014

(65) Prior Publication Data

US 2015/0096778 A1 Apr. 9, 2015

(30) Foreign Application Priority Data

Oct. 4, 2013 (DE) ..... 10 2013 016 328.5
Mar. 11, 2014 (DE) ..... 10 2014 204 380.8

(51) Int. Cl.

| | |
|---|---|
| ***B25B 23/00*** | (2006.01) |
| ***B25F 5/02*** | (2006.01) |
| ***H01B 17/56*** | (2006.01) |
| ***B25F 3/00*** | (2006.01) |
| ***B25B 21/00*** | (2006.01) |

(52) U.S. Cl.

CPC ..... *H01B 17/56* (2013.01); *B25B 21/002* (2013.01); *B25B 23/0035* (2013.01); *B25F 3/00* (2013.01); *B25F 5/02* (2013.01); *Y10T 29/49826* (2015.01)

(58) Field of Classification Search

CPC ..... H02K 7/145; B25B 21/002; B25F 5/02; H01B 17/56

USPC ..... 173/1–11, 213

See application file for complete search history.

(56) References Cited

U.S. PATENT DOCUMENTS 470,687 A * 3/1892 Koelzer ..... B25B 15/007 81/436
3,685,843 A * 8/1972 Jacyno ..... B23B 31/1207 408/239 R
3,761,774 A * 9/1973 Laughinghouse ..... H01H 13/08 361/45
3,797,960 A * 3/1974 McCarthy ..... B23B 31/1207 174/138 D
3,871,138 A * 3/1975 Welsch ..... B24B 23/02 279/46.2
3,874,465 A * 4/1975 Young ..... E21B 25/02 175/236
3,910,589 A * 10/1975 Derbyshire ..... B23B 31/1238 279/125
4,332,178 A * 6/1982 Vukich ..... B25B 13/00 401/7
4,476,941 A * 10/1984 Buck ..... B25D 17/06 173/117
4,585,077 A * 4/1986 Bergler ..... B23B 31/1238 173/13
4,605,345 A * 8/1986 Giughese ..... B23B 35/005 408/241 B (Continued)

*Primary Examiner* — Robert F Long

(74) *Attorney, Agent, or Firm* — Maginot, Moore & Beck LLP

(57) ABSTRACT

An insulation system for a tool includes a first element configured to electrically insulate an output unit of the tool from a detachably receivable tool element of the tool that is configured to process a workpiece. The insulation system further includes and a second element configured to electrically insulate the output unit toward the outside. A method includes mounting the insulation system on the tool.

16 Claims, 1 Drawing Sheet

(56) References Cited

U.S. PATENT DOCUMENTS 4,976,173 A * 12/1990 Yang ..... B25F 3/00 173/46
5,018,411 A * 5/1991 La Padura ..... B25B 13/56 81/437
5,074,172 A * 12/1991 Fetter ..... B25B 13/483 81/124.3
5,259,277 A * 11/1993 Zurbuchen ..... B25B 15/02 81/177.1
5,340,310 A * 8/1994 Bifulk ..... A61C 17/00 433/122
5,347,684 A * 9/1994 Jackson ..... A47J 45/10 16/421
5,349,886 A * 9/1994 Jin ..... B25B 15/02 81/177.1
5,407,018 A * 4/1995 Henry ..... B25D 17/11 173/162.1
5,465,983 A * 11/1995 Owens ..... B23B 31/001 279/157
5,839,517 A * 11/1998 Gwinn ..... B25D 17/043 173/162.2
5,842,584 A * 12/1998 Baird ..... B25F 5/029 206/379
5,867,868 A * 2/1999 Ward ..... A63B 49/08 16/422
6,096,042 A * 8/2000 Herbert ..... A61B 17/1633 606/79
6,295,904 B1 * 10/2001 Webb ..... B25B 15/02 81/177.6
6,668,687 B1 * 12/2003 Miller ..... B25B 15/00 81/35
6,671,931 B1 * 1/2004 Duncan ..... B25F 5/006 16/430
6,821,157 B2 * 11/2004 Brandstrom ..... B25B 23/14 173/20
7,261,016 B2 * 8/2007 Miller ..... B25G 1/007 81/177.1
7,316,528 B2 * 1/2008 Cooper ..... B27C 5/10 144/136.95
7,334,614 B2 * 2/2008 Cooper ..... B27C 5/02 144/136.95
7,451,791 B2 * 11/2008 Cooper ..... B25F 5/02 144/136.95
7,665,541 B2 * 2/2010 Sakai ..... B25B 21/02 173/122
7,682,102 B1 * 3/2010 Burke ..... E01C 19/35 404/133.05
8,042,717 B2 * 10/2011 Lam ..... B25C 1/008 227/120
8,132,990 B2 * 3/2012 Bauman ..... B23B 31/008 279/137
8,235,137 B2 * 8/2012 Walker ..... B25B 21/00 173/216
8,272,453 B2 * 9/2012 Ullrich ..... B25D 17/06 173/131
8,544,561 B2 * 10/2013 Aihara ..... B25C 1/047 173/162.1
2002/0134562 A1 * 9/2002 Paul ..... B25D 9/04 173/114
2003/0116335 A1 * 6/2003 Milbourne ..... B25B 21/00 173/170
2004/0111933 A1 * 6/2004 Yoshimizu ..... G09F 3/02 40/299.01
2005/0135890 A1 * 6/2005 Bauman ..... B23B 31/008 408/239 R
2005/0178251 A1 * 8/2005 Holland-Letz ..... B25B 15/02 81/438
2005/0279518 A1 * 12/2005 Kawamoto ..... B25F 5/006 173/210
2006/0037766 A1 * 2/2006 Gass ..... B23B 31/123 173/20
2006/0186612 A1 * 8/2006 Puzio ..... B23B 31/06 279/62
2006/0233618 A1 * 10/2006 Puzio ..... B23B 31/001 408/67
2007/0074883 A1 * 4/2007 Strasser ..... B25D 16/006 173/104
2007/0114259 A1 * 5/2007 Bromley ..... B23P 19/062 227/120
2007/0163804 A1 * 7/2007 Auray ..... H02G 3/0691 174/666
2008/0006419 A1 * 1/2008 Harcar ..... B25D 17/00 173/114
2008/0167671 A1 * 7/2008 Giordano ..... A61B 17/07207 606/167
2008/0196910 A1 * 8/2008 Radle ..... G01V 3/15 173/2
2009/0166394 A1 * 7/2009 Gyorkos ..... B25C 1/04 227/142
2010/0326688 A1 * 12/2010 Ullrich ..... B25D 17/06 173/114
2011/0005786 A1 * 1/2011 Ostensson ..... B25D 11/005 173/20
2011/0073343 A1 * 3/2011 Sawano ..... B25F 5/00 173/217
2011/0083870 A1 * 4/2011 McCarty, II ..... B25D 17/11 173/211
2011/0100665 A1 * 5/2011 Nakashima ..... B23D 51/01 173/162.2
2012/0085561 A1 * 4/2012 Sauter ..... A61C 1/08 173/213
2012/0255749 A1 * 10/2012 Seith ..... B25B 13/06 173/1
2014/0276839 A1 * 9/2014 Forman ..... A61B 17/1624 606/80
2015/0136433 A1 * 5/2015 Nitsche ..... B25D 16/006 173/2
2015/0336246 A1 * 11/2015 Peters ..... B23B 31/107 81/439
2018/0043523 A1 * 2/2018 Sze ..... B25B 7/08

* cited by examiner

INSULATION SYSTEM FOR A TOOL, TOOL, AND METHOD FOR MOUNTING THE INSULATION SYSTEM ON THE TOOL

This application claims priority under 35 U.S.C. § 119 to patent application nos. DE 10 2013 016 328.5, filed on Oct. 4, 2013 in Germany, and DE 10 2014 204 380.8, filed on Mar. 11, 2014, the disclosures of which are incorporated herein by reference in their entirety.

BACKGROUND

The present disclosure relates to an insulation system for a tool, a tool, and a method for mounting the insulation system on the tool. The tool is in particular a screwdriving/drilling tool that is holdable in the hand of a user.

In the automobile industry, tools, for example screwdriving tools, are used in the mounting of batteries of electric vehicles. The batteries are generally storage batteries which consist of a plurality of elements which are intended to be screwed together. In this case, the screws are also intended to be screwed into live parts. In this case, the protection of an operator of the tool from electrical voltages, which are dangerous for the operator, should be ensured.

Currently, this is realized for example by the tool being wrapped with insulating tape. However, this is very laborious and susceptible to error. In addition, it is only possible to avoid contact with live parts as a result. However, it is not possible to prevent at least introduction of the electrical voltages from the workpiece to be processed into the tool.

Therefore, it is the object of the present disclosure to provide an insulation system for a tool, a tool, and a method for mounting an insulation system on a tool, with which the abovementioned problems can be solved. In particular, provision is intended to be made of an insulation system for a tool, a tool, and a method for mounting an insulation system on a tool, in which both the tool and the operator thereof are protected from electrical voltages which occur on a workpiece to be processed with the tool.

SUMMARY

This object is achieved by an insulation system for a tool according to the disclosure.

Advantageous further configurations of the insulation system are specified in the dependent claims.

The insulation system for a tool provides a coherent overall concept which ensures that both the tool and the operator thereof are protected from electrical voltages which occur on a workpiece to be processed with the tool. Introduction of the electrical voltages from the workpiece to be processed into the tool is prevented. As a result, provision is made of an overall solution for example of a screw system for category A screw connections, said screw system making it possible to operate under "live working" conditions.

The insulation system is easily retrofittable and can thus be used in any desired standard screwdriver. This is also advantageous for the keeping of spare parts for a user of the tool.

The insulation system achieves the abovementioned object in an easy and readily manageable manner. The insulation system contributes to high process reliability of the tool.

The object is also achieved by a tool according to the disclosure.

Advantageous further configurations of the tool are specified in the dependent claims.

The tool achieves the same advantages as were mentioned above with regard to the insulation system.

The object is also achieved by a method for mounting an insulation system on a tool according to the disclosure.

Advantageous further configurations of the method are specified in the dependent claims.

The method achieves the same advantages as were mentioned above with regard to the insulation system.

Further possible implementations of the disclosure also comprise combinations that are not explicitly mentioned of features or embodiments that are described above or in the following text with regard to the exemplary embodiment.

Here, a person skilled in the art will also add individual aspects as improvements or additions to the particular basic form of the disclosure.

BRIEF DESCRIPTION OF THE DRAWINGS

The disclosure is described in more detail in the following text with reference to the appended drawings and by way of an exemplary embodiment. In the drawings.

DETAILED DESCRIPTION

In the figures, identical or functionally identical elements are provided with the same reference signs, unless stated to the contrary.

Figure 1:
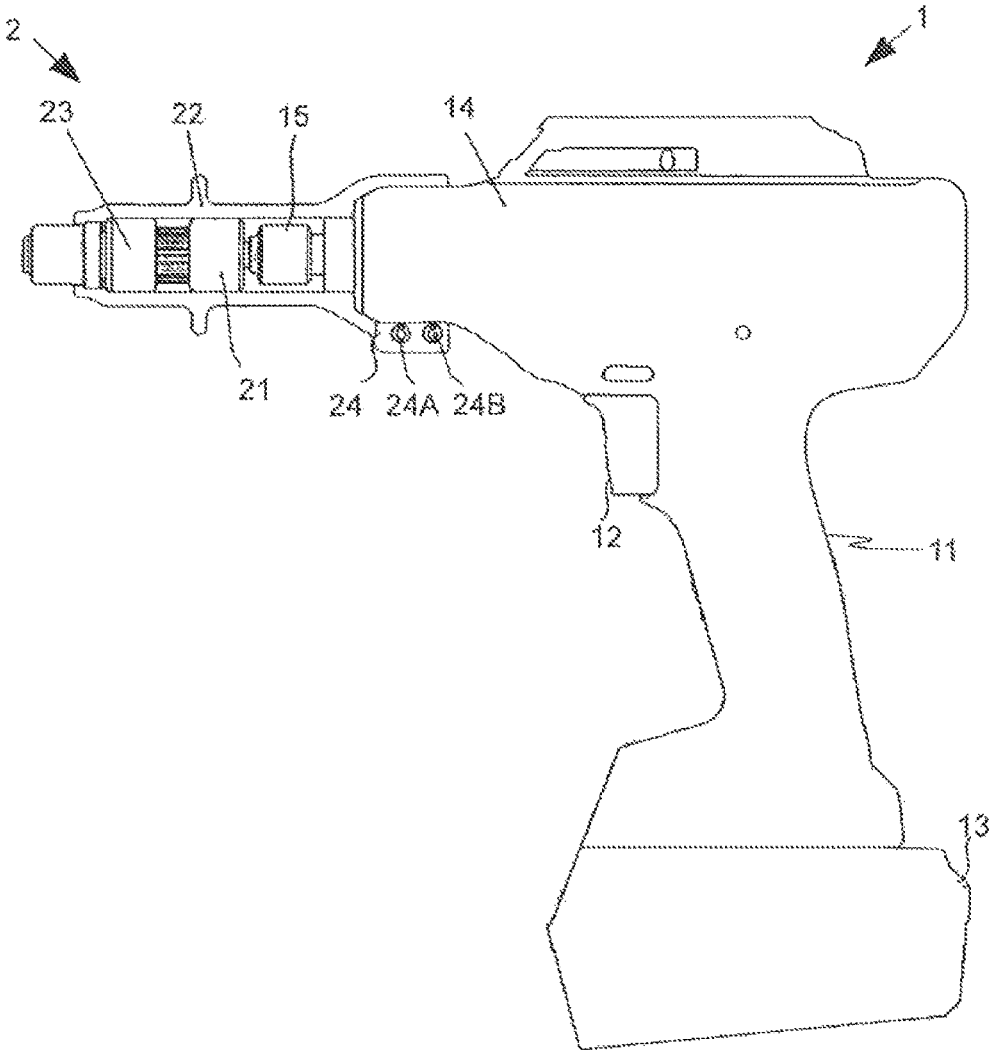
FIG. 1 shows a side view of a tool having an insulation system according to one exemplary embodiment.

FIG. 1 shows a tool 1 having an insulation system 2. The tool 1 may be a screwdriving tool, a drilling tool, a riveting tool, a punching tool, a bolt-firing tool, etc. The tool 1 in FIG. 1 is a tool that is holdable in the hand. However, the tool 1 is not limited thereto. The tool 1 can also be a stationary tool or bench tool.

In FIG. 1, the tool 1 has a handle 11, an on/off switch 12, a battery compartment 13, a housing 14, and an output unit 15. The insulation system 2 has a first element 21, a second element 22, a receiving element 23, and a fastening unit 24.

A battery, for example a rechargeable battery or a non-rechargeable battery, can be received in the battery compartment 13. As a result, the tool 1 is a cordless tool. The housing 14 is made of a material, for example plastics material, etc., which acts in an electrically insulating manner. As a result, in the region of the housing 14, the tool 1 has a surface made of an electrically insulating material. However, at the output unit 15, the tool 1 has a metal housing, in particular a steel housing. Thus, the output unit 15 has an electrically conductive housing. The output unit 15 is configured to receive a tool element (not illustrated) by way of which the tool 1 can process a workpiece. For example, the output unit 15 is a quick-action chuck for receiving a screwdriver bit, drill bit, etc.

The first element 21 is an electrically insulated and electrically insulating extension which is received by the output unit 15. The first element 21 can be snapped into the output unit 15, as described below. The second element 22 is a housing made of an electrically insulating material, for example plastics material, etc. For example, the second element 22 is a one-piece housing. The second element 22 can receive, in particular enclose, the output unit 15 and the first element 21, as shown in FIG. 1. In addition, the second element 22 receives the receiving element 23. In this case, the second element 22 engages in the receiving element 23 or bears against the latter such that the receiving element 23 projects partially out of the second element 22, as shown in FIG. 1. At its end facing the tool 1, the second element 22 is slotted at the fastening unit 24 and provided with two fastening elements 24A, 24B. By way of the fastening unit 24, the second element 22 can be fastened to the housing 14 of the tool 1 using the two fastening elements 24A, 24B. The fastening elements 24A, 24B are two fastening elements 24A, 24B that are arranged in the radial direction of the output unit 15, as shown in FIG. 1. The fastening elements 24A, 24B are fastening elements that are attached preferably in a recessed manner, for example clamping screws, etc., which clamp the second element 22 and thus the insulation system 2 to the housing 14 of the tool 1.

Figure 2:
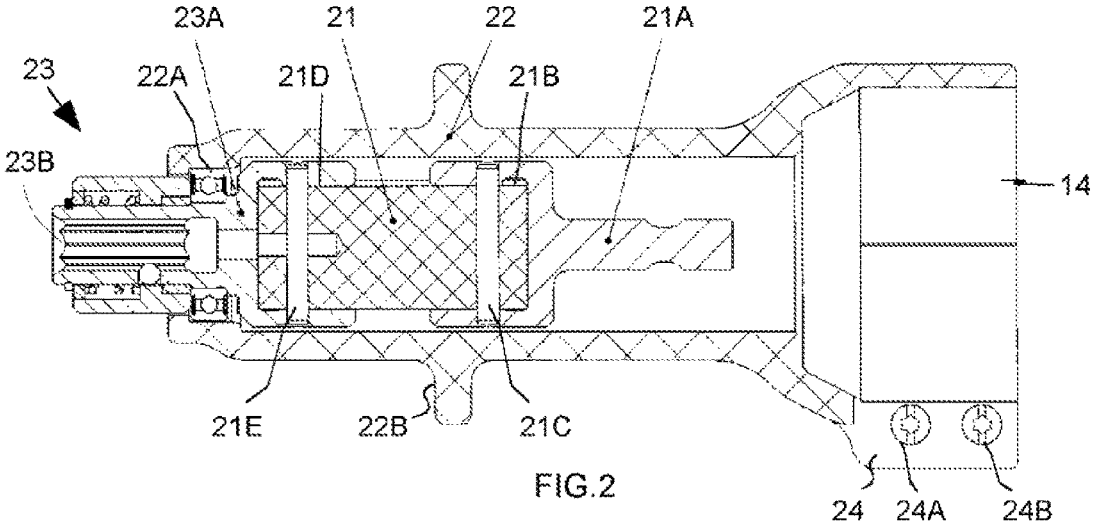
FIG. 2 shows a sectional view of an insulation system of the tool according to the exemplary embodiment.

FIG. 2 shows the structure of the insulation system 2 in more detail. Accordingly, a drive flange 21A for the first element 21 is provided. The drive flange 21A is arranged in the output unit 15 of the tool 1, and in particular is snapped on to the output unit 15. The first element 21 is arranged on the drive flange 21A via a form-fitting toothing 21B. The first element 21 is axially secured via a clamping pin 21C. In addition, at its other end, the first element 21 is arranged via a form-fitting toothing 21D on an output flange 23A which is connected to a quick-action chuck 23B of the receiving element 23. The first element 21 is axially secured, here too, via a clamping pin 21E.

By way of the first element 21, a screwing point on a workpiece is electrically disconnected from the tool 1.

In order to reduce the radial play of the insulating output shaft made up of the drive flange 21A, first element 21 and output flange 23A, said output shaft is mounted in the front region of the second element 22 by way of a bearing 22A. Mounting takes place by way of the form-fitting toothings 21B, 21D. The second element 22, as insulating housing, has a collar 22B which bounds the gripping region for the user of the tool 1. The collar 22B projects, as a ring, outwardly out of the second element 22. By way of the collar 22B, the user of the tool 1 feels where the region that is dangerous, because it is live, on the insulating system 2 begins.

Accordingly, the tool 1 in FIG. 1 and FIG. 2 is a cordless portable screwdriver which apart from the clamping flange on the output, the output unit 15, and the output shaft itself has a surface made of plastics material. The cordless embodiment of the tool 1 is also advantageous in order to avoid transfer of potential via a cord.

The above-described solution consists in the following procedure being carried out in a method for mounting the insulation system 2 on a tool 1. In the output unit 15, in particular the quick-change chuck thereof, an insulated and insulating extension in the form of the element 21 is snapped on by means of the drive flange 21A. Subsequently, the insulating housing of the insulation system 2, that is to say the second element 22, is pushed onto the housing of the tool 1 via the insulating extension. Fixing in the arrangement shown in FIG. 1 and FIG. 2 takes place in this case by way of the fastening unit 24 and by the radial clamping screws, the fastening elements 24A, 24B, which are arranged in a recessed manner.

The insulation system 2 can be retroactively mounted on a conventional standard screwdriver. This simplifies the keeping of spare parts for the user of the tool 1.

A commercially available hexagon key can be fitted, as a tool element that is not illustrated, in the quick-change chuck 23B of the receiving element 23. Thus, the receiving element 23 is configured for detachably receiving or mounting the tool element that is not illustrated.

In summary, by way of the insulation system 2, the desired additional electrical insulation of the tool 1 from electrical voltages on a workpiece to be processed by way of the tool 1 can be realized.

According to a second exemplary embodiment, no mounting of the output shaft made up of the drive flange 21A, first element 21 and output flange 23A by way of the bearing 22A is provided to reduce the radial play of the insulating output shaft.

Otherwise, in the present exemplary embodiment, too, the tool 1 and its insulation system 2 are constructed in the same way as described with reference to the first exemplary embodiment.

According to a third exemplary embodiment, no collar 22B which bounds the gripping region for the user of the tool 1 is provided. This makes it easier to produce the second element 22. The collar 22B is not necessarily required if a user of the tool 1 does not have to or will not grip the tool 1 at the second element 22, for example, when processing a live workpiece.

Otherwise, in the present exemplary embodiment, too, the tool 1 and its insulation system 2 are constructed in the same way as described with reference to the first exemplary embodiment.

According to a fourth exemplary embodiment, the insulation system 2 is embodied such that the receiving element 23 and the first element 21 cannot be removed from the tool 1 without removing the second element 22. Such a construction prevents easy, for example tool-free, changing of the insulated output by an operator of the tool 1. As a result, safety for the tool 1 and its operator can be further increased.

Otherwise, in the present exemplary embodiment, too, the tool 1 and its insulation system 2 are constructed in the same way as described with reference to the first exemplary embodiment.

All of the above-described configurations of the tool 1 and of the insulation system 2 can be used individually or in any possible combinations. In particular, all of the features and/or functions of the above-described exemplary embodiments can be combined as desired. In addition, in particular the following modifications are conceivable.

The parts illustrated in the figures are illustrated schematically and the precise configuration thereof can deviate from the forms shown in the figures, as long as their above-described functions are ensured.

One or both of the fastening elements 24A, 24B can, if necessary, also be embodied in some other manner than by way of a screw. Fastening means in the form of welding, adhesive bonding, a snap-connection, etc., are also possible for the two fastening elements 24A, 24B.

What is claimed is:

1. An insulation system for a tool, comprising:

an extension configured to electrically insulate an output unit of the tool from a detachably receivable tool element of the tool, the output unit extending outwardly from a housing of the tool and configured to drive the detachably receivable tool element to perform a mechanical process on a workpiece, wherein the extension is configured to extend between the output unit and the detachably receivable tool element along a longitudinal axis, with a first end portion of the extension operably connected to the output unit and a second end portion of the extension spaced apart from the first end portion along the longitudinal axis and operably connected to the detachably receivable tool element; and a housing configured to electrically insulate the output unit in a direction radially outwardly of the output unit relative to the longitudinal axis.

2. The insulation system according to claim 1, further comprising:

a receiving element operably connected to the second end portion and configured to detachably receive the detachably receivable tool element, wherein:

the housing is configured to receive the output unit and the receiving element at least partially therein.

3. The insulation system according to claim 1, wherein:

the housing has a bearing configured to reduce radial play of an insulating output shaft, and the insulating output shaft comprises a drive flange, the extension, and the receiving element.

4. The insulation system according to claim 1, wherein the housing is configured such that the receiving element is removable only with removal of the housing from the tool.

5. The insulation system according to claim 1, wherein the housing engages around one end of the tool and/or is a plastics housing.

6. The insulation system according to claim 1, wherein the extension is an electrically insulating and insulated element that fits by way of a form-fitting toothing at the first end portion in a drive flange, wherein the drive flange is configured to be arranged in the output unit, and wherein the output unit is a quick-change chuck.

7. A tool, comprising:

an output unit extending outwardly from a housing of the tool and configured to drive a detachably receivable tool element to perform a mechanical process on a workpiece;

an insulation system extension extending between the output unit and the detachably receivable tool element along a longitudinal axis, with a first end portion of the extension operably connected to the output unit and a second end portion of the extension spaced apart from the first end portion along the longitudinal axis and operably connected to the detachably receivable tool element, the extension configured to electrically insulate the output unit from a receiving element, the receiving element configured to detachably receive the detachably receivable tool element; and an insulation system housing configured to electrically insulate the output unit in a direction radially outwardly of the output unit relative to the longitudinal axis.

8. The tool according to claim 7, wherein the tool is configured as one or more of a cordless tool and a screw-driving/drilling tool.

9. A method for mounting an insulation system for a tool on the tool, comprising:

providing an extension configured to extend between an output unit of the tool and a detachably receivable tool element along a longitudinal axis, with a first end portion of the extension operably connected to the output unit and a second end portion of the extension spaced apart from the first end portion along the longitudinal axis and operably connected to the detachably receivable tool element;

mounting the extension to the output unit of the tool, the output unit extending outwardly from a housing of the tool such that the extension is arranged so as to electrically insulate the output unit from the detachably mountable tool element of the tool, the detachably mountable tool element configured to perform a mechanical process on a workpiece, the output unit configured to drive the detachably mounted tool element; and mounting an extension system housing radially outwardly of the output unit such that the extension system housing is arranged to electrically insulate the output unit in a radially outward direction.

10. The method according to claim 9, wherein:

the extension system housing is configured as a one-piece plastics housing, mounting the extension system housing includes pushing at least a portion of the extension system housing over a receiving element, the extension, and then the output unit, and the receiving element is configured to detachably receive the detachably receivable tool element.

11. The method according to claim 10, further comprising:

fastening the extension system housing to the housing of the tool by way of at least one radial fastening element.

12. The method according to claim 9, further comprising:

fastening the extension system housing to the housing of the tool by way of at least one radial fastening element.

13. The insulation system according to claim 2, wherein:

the extension system housing encloses the output unit and the extension, and the receiving element projects out of the extension system housing.

14. The insulation system according to claim 1, further comprising:

a receiving element configured to detachably receive the detachably receivable tool element, wherein:

the housing encloses the output unit and the extension, and the receiving element projects out of the housing.

15. The insulation system according to claim 3, wherein the housing has a collar configured to bound a gripping region for the user of the tool.

16. The insulation system according to claim 1, wherein the housing has a collar configured to bound a gripping region for the user of the tool.

* * * * *